US006607215B2

(12) United States Patent
Nomura

(10) Patent No.: US 6,607,215 B2
(45) Date of Patent: Aug. 19, 2003

(54) SCRAPBOOK

(75) Inventor: Yasuji Nomura, Minou (JP)

(73) Assignee: Nakabayashi Co., Ltd. (JP)

( * ) Notice: Subject to any disclaimer, the term of this patent is extended or adjusted under 35 U.S.C. 154(b) by 0 days.

(21) Appl. No.: 09/898,120

(22) Filed: Jul. 3, 2001

(65) Prior Publication Data

US 2002/0051675 A1 May 2, 2002

(30) Foreign Application Priority Data

Jul. 6, 2000 (JP) ..... 2000-205517

(51) Int. Cl.[7] ..... B42F 5/00

(52) U.S. Cl. ..... 281/22; 281/29; 281/37; 402/70; 402/73

(58) Field of Search ..... 281/21.1, 22, 29, 281/36, 37, 38, 45; 402/70, 73, 79

(56) References Cited

U.S. PATENT DOCUMENTS 5,335,027 A * 8/1994 Lin et al. ..... 402/79
5,924,736 A * 7/1999 Russo ..... 281/38
6,045,161 A * 4/2000 Ashcraft et al. ..... 281/37

FOREIGN PATENT DOCUMENTS

| | | |
|---|---|---|
| JP | 29-4106 | 4/1922 |
| JP | 50-10021 | 3/1975 |
| JP | 51-31053 | 8/1976 |
| JP | 57-47185 | 10/1982 |

* cited by examiner

*Primary Examiner*—Willmon Fridie, Jr.
(74) *Attorney, Agent, or Firm*—Thompson Hine LLP

(57) ABSTRACT

A scrapbook includes a spine adapted to bind a variable plurality of binder inserts; includes a substantially rectangular and planar front cover coupled to the spine, where the front cover includes a co-planar storage area, a window in its front surface opening onto the co-planar storage area and an opening into the co-planar storage area; and includes a substantially rectangular and planar, bag-like display sheet that has a substantially transparent front wall and a back wall, and is adapted to receive contents for display therein, and is also adapted to be inserted through the opening of the front cover and into the co-planar storage area of the front cover such that the contents for display may be seen through the window and the transparent front wall.

17 Claims, 4 Drawing Sheets

SCRAPBOOK

FIELD OF THE INVENTION

The present invention relates to an improvement in a scrapbook which becomes able to increase or decrease the number of binder inserts, and a scrapbook wherein a storage portion in a front cover having a display window is provided to decorate the cover by inserting a bag-like display sheet thereinto.

DESCRIPTION OF THE PRIOR ART

There already exists a scrapbook and an album capable to increase or decrease the number of binder inserts. For example, U.S. Pat. No. 3,224,450 relates to a flexible post binder, where a pair of flexible post is provided within a support portion in a back cover. After binder inserts are hung on the flexible posts through holes provided in the binder inserts, and after the front cover is hung or the flexible posts, the flexible posts are designed to be bent opposite to each other and kept fixed with top ends of the flexible posts pressed by a compression mechanism carried on the front cover of the binder. With the above structure, the desired number of binders insert can be varied. As to an album, instead of flexible posts, a long-cylindrical screw having plates in both ends thereof is also known.

Also, there has been an well known album having a display window provided within a cover, where a small display window is provided within the center of the cover to put a photo thereinto for decoration, and where the back of the small display window is covered up with a plastic plate to protect a surface of the photo. With such a plastic plate or a transparent film provided in the back thereof to protect a photo, a protuberance with thickness equal to that of a plastic plate or the like is formed. Therefore, it may happen that a photo is caught by the protuberance and ends of the photo may be damaged when inserted. As a photo for decoration is usually the most popular one for a user, having damage therein is not favorable.

On the other hand, it is not known to provide scrapbook having such a window. Even if a window is provided within a cover of a scrapbook, displaying a content is difficult since various shapes and sizes of things are filed as contents. This problem cannot be solved with applying a structure of a conventional display window of an album.

SUMMARY OF THE INVENTION

To solve the problem, an embodiment of the present invention adapts a scrapbook which becomes capable to increase or decrease the number of binder inserts, wherein a front cover has a double-structure to form a storage portion having an opening at one side thereof. The scrapbook is further composed of a display window provided within the upper cover of the front cover, and a bag-like display sheet that slides into the storage portion.

With such a scrapbook, filing contents can be displayed by the display window provided within a frame in the front cover by inserting the display sheet into the storage portion, and insertion of the display sheet is greatly facilitated.

With the scrapbook, the display sheet is made of a transparent synthetic resin sheet and has a bag-like structure having an opening at one side thereof, whereby a board of a binder insert can be slid thereinto.

By removing a board from a binder insert and by placing the board into the display sheet, filing contents can be exhibited in the display window.

Further, in another embodiment, a bag-like display sheet is provided, wherein a transparent synthetic resin sheet is laid on a surface of a thin board and three sides thereof are adhered.

A display sheet is to be strengthened by applying a thin board, and insertion into a front cover can be notably facilitated.

(A) illustrates the sliding of a bag-like display sheet into a cover.

(B) is a cross sectional view of a scrapbook according to the present invention.

(C) is an enlarged sectional view of the scrapbook of FIG. 2(B) showing a bound state.

FIG. 3

(A) illustrates the step of removing a board from a binder insert.

(B) illustrates the step of sliding a board into a bag-like display sheet.

Figure 4:
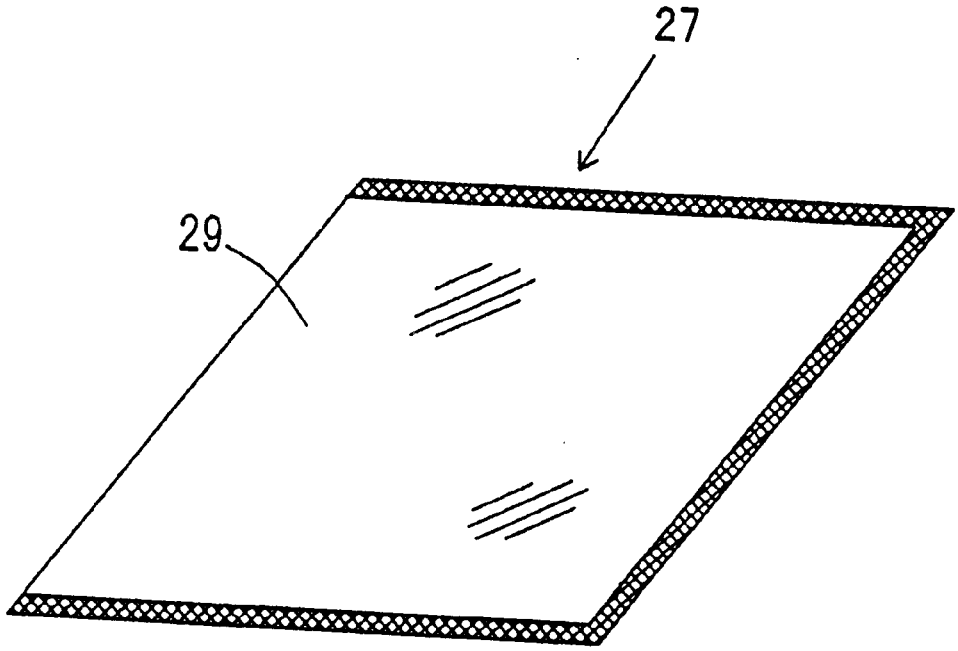

FIG. 4 is a perspective view showing another embodiment of a bag-like display sheet.

DETAILED DESCRIPTION OF THE PREFERRED EMBODIMENT

Figure 1:
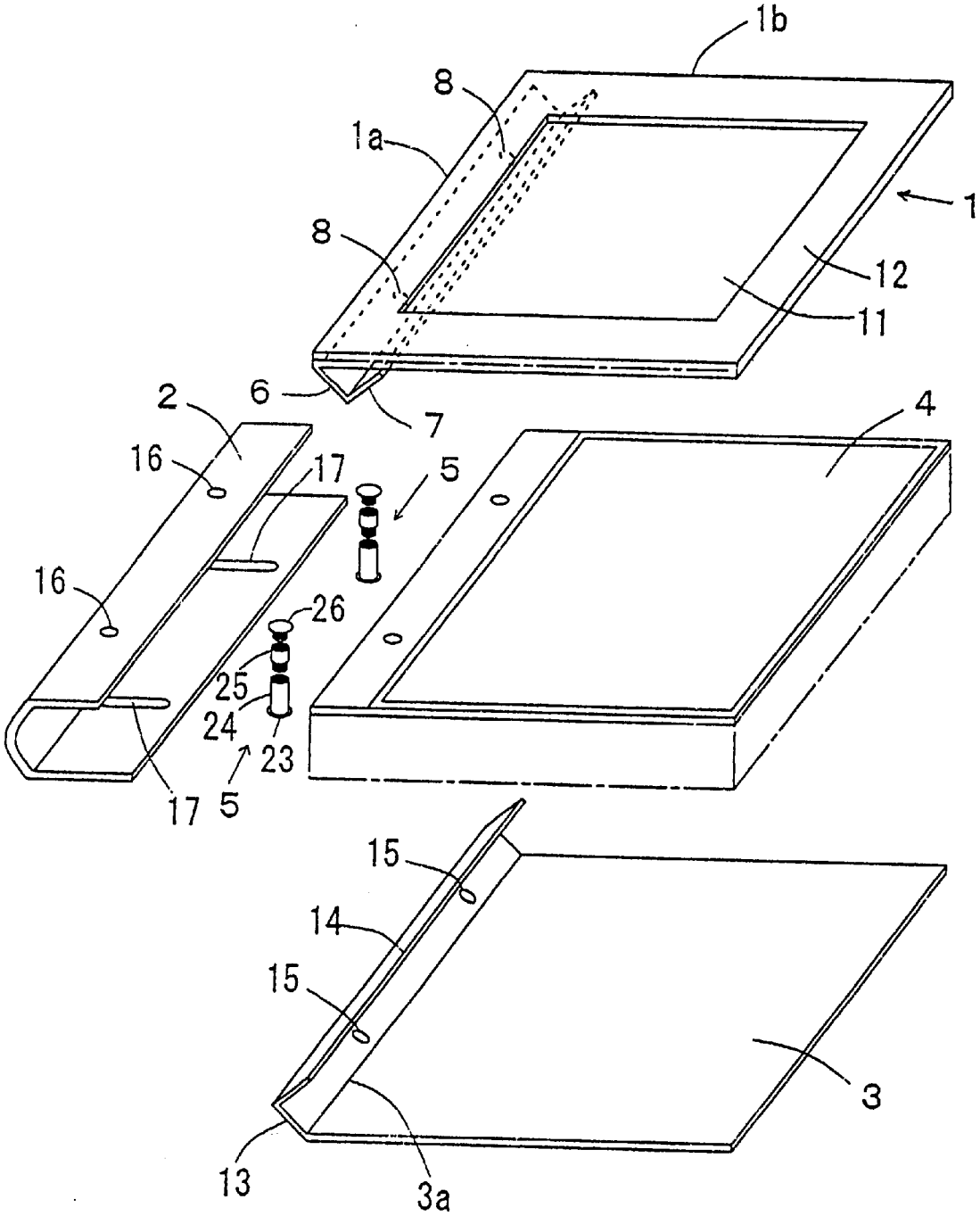
FIG. 1 is an exploded perspective view showing a basic structure of a scrapbook according to the present invention.

Preferred embodiments of a scrapbook in the present invention are discussed hereinafter with referring to drawings. FIG. 1 is an exploded perspective view showing the whole basic structure of a scrapbook, including a front cover 1, a spine 2, a back cover 3, a binder insert 4, and pegs 5.

Figure 2:
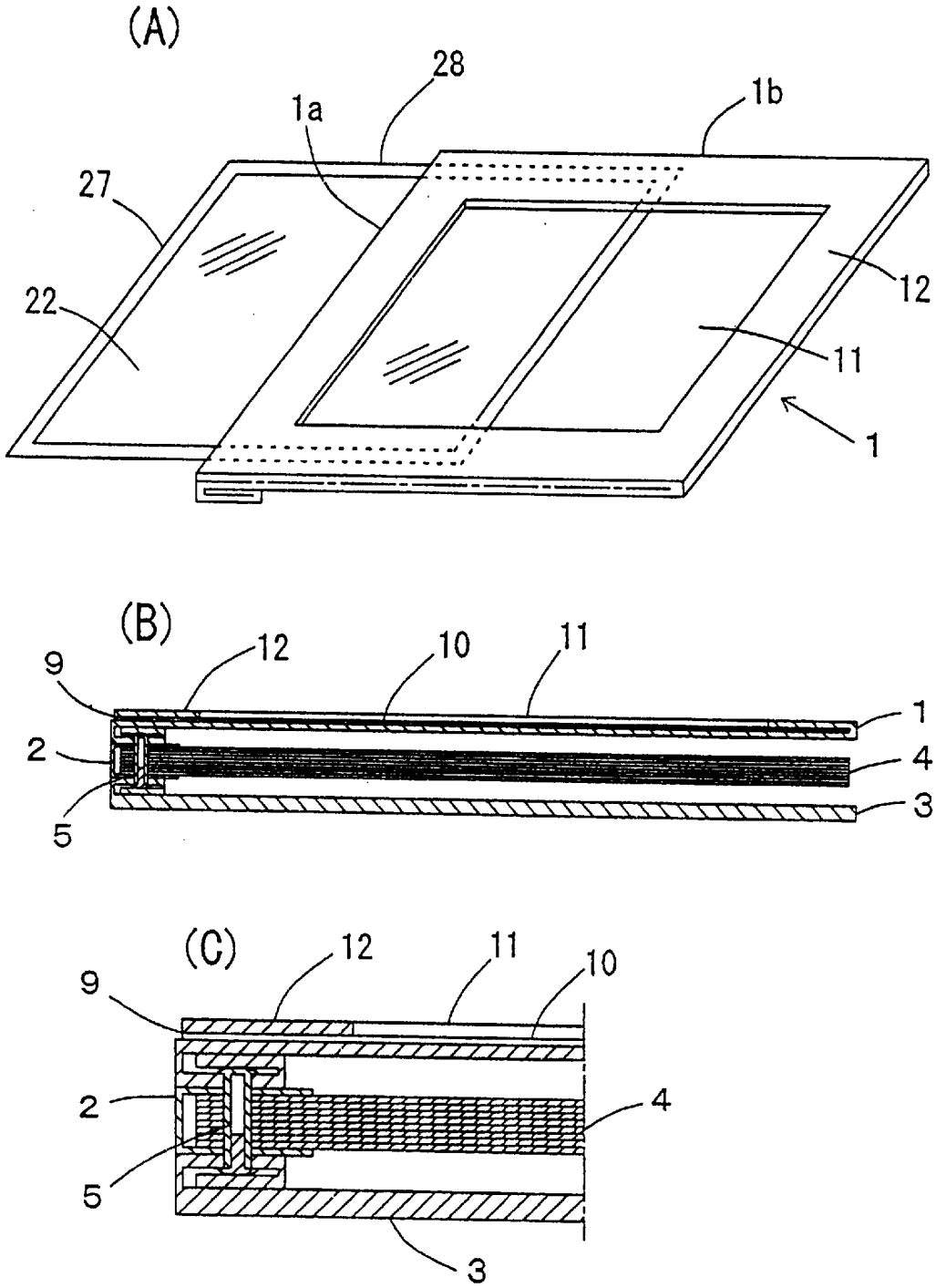
FIG. 2

An inward fold 6 and an outward fold 7 capable to be in a folio are co-provided within a bound side 1*a* of the front cover 1 and holes 8 having predetermined intervals are provided within the inward fold 6. As shown in FIG. 2, the front cover 1 has a double-structure having the upper and lower covers, and a storage portion 10 having an opening 9 at abound side 1*a*. A frame 12 is formed by providing a display window 11 in the center of a surface of the upper cover. A bag-like display sheet can slide into the storage portion 10 and contents stored inside of the display sheet can be seen through the display window 11 in the frame 12. In addition, the opening 9 may be provided at the top 1*b* of the front cover 1.

An inward fold 13 and an outward fold 14 capable to be in a folio are co-provided at a bound side 3*a* in the back cover 3, and holes 15 having predetermined intervals are provided within the inward fold 13. The outward folds 7 and 14 in each of the front and back covers are designed to have better appearance by hiding both ends of the pegs 5 and to protect damage in the back sides of each of the cover 1 and 3 by ends of the pegs 5.

The spine 2 is composed of a flexible sheet and capable to bend in accordance with thickness of the entire binder inserts 4. While holes 16 having predetermined intervals are provided within one end of the spine, long-holes 17, of which positions are opposite to the holes 16, are provided within another end of the spine. With the long-holes 17, the width of the spine 2 becomes variable corresponding to increase of the number of binder inserts.

Figure 3:
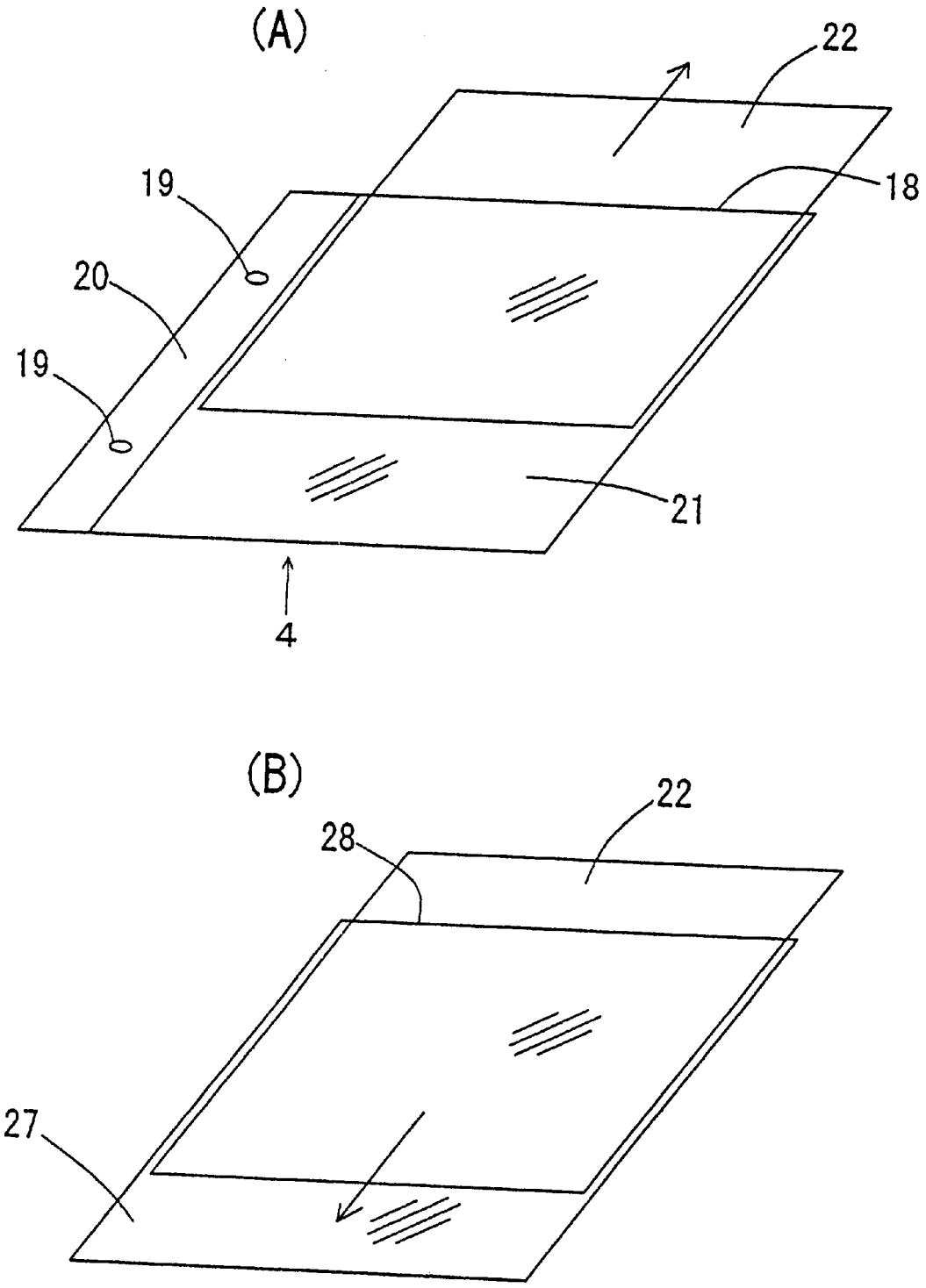

As shown in FIG. 3(A), the binder insert 4 is a bag-like sheet having an opening 18 in the top thereof, and composed of a transparent synthetic resin such as polypropylene. Further a binding portion 20, wherein holes 19 having predetermined intervals are set, are provided at binding side. A bag portion 21 is designed to store a board 22. While users may file newspaper and/or magazine clippings into the bag portion 21 directly, they can adhere sheet-shaped remembrances such as an admission ticket, a ticket, a pamphlet or a photo and seals, and also draw a picture on the board 22. By binding a number of binder inserts decorated as described above, the present invention can be used as a scrapbook or a memorial book.

The peg 5 is comprised of cylindrical support 24, of which one end is fastened with a plate 23, an extension support 25, of which one end is to be screwed onto another end of the cylindrical support 24, and a bolt 26 to be screwed onto another end of the extension support 25.

As shown in FIG. 2(C), the peg 5 is to bind the desired number of binder inserts between the front cover 1 and back cover 3 by inserting thereof from the back of the hole 15 in the back cover to the hole 8 in the front cover through the long-hole 17 in the spine, the hole 19 in the binder insert and the hole 16 in the spine. Binding width can be adjustable in correspondence with the increase or decrease of binder inserts with the number of the extension support 25.

As shown in FIG. 2(A), a bag-shaped display sheet 27 is adapted to exhibit its contents through the display window 11 in the cover 1 when it is inserted into the opening 9 in the front cover 1 to the storage portion 10. The display sheet is composed of a transparent synthetic resin such as polypropylene and has a bag-like structure having an insertion opening 28 at one end thereof. Users can directly insert a sheet-shaped thing such as a photo or a pamphlet to exhibit contents of the thing as decoration of a front cover of a scrapbook. Also, as shown in FIG. 3(B), the board 22 in the binder insert can be removed to slide into the bag-like display sheet. In the above manner, users can exhibit the most popular board through the display window 11 in the front cover 1 even after mementos are filed on each binder insert.

The composition of the frame 12 in the front cover 1 and the bag-like display sheet in the present invention enables the display sheet to slide out smoothly without being hooked. Further, exhibit contents are protected and free from damage due to the bag-like construction of the display sheet. Also, exhibitions can be easily exchanged by replacing a board 22.

As shown in FIG. 4, the bag-like display sheet may have a composition, wherein a thin board 29 is laid on a transparent synthetic resin sheet and three ends thereof are adhered to form a bag-like structure. A bag-like display sheet with the above composition has the same capability for storing and displaying exhibitions in a display window as the display sheet of the embodiments discussed above. However, solidness of the thin board 29 facilitates to slide thereof in and out from the storage portion 10 in the front cover 1.

The present invention offers a scrapbook, wherein front cover has a double structure to form a storage portion and a display window is provided therewithin. Therefore, filing contents can be exhibited through the display window by sliding a bag-like display sheet into the storage portion, which results in heightening a decorative characteristic. Moreover, as an advantage, ends or surfaces of filing contents are free from damage for a way of storage that is first to store filing contents into a transparent bag-shaped display sheet and then to insert the display sheet into the storage portion. Also, sliding a bag-shaped display sheet is greatly facilitated in a manner of inserting thereof into a storage portion which has no gap.

Users also can exhibit the most popular content among filed clippings in a scrapbook by removing a board from a binder insert to a bag-like display sheet and sliding the display sheet into a storage portion.

What is claimed:

1. A scrapbook comprising:

a front cover having multi-layer structure forming a storage portion having an opening at a bound side thereof, between an upper layer and a lower layer of said multi-layer structure; and a bag-like display sheet, adapted to slide into said storage portion, wherein said display sheet is composed of a transparent synthetic resin sheet and has a bag-like structure having an opening at one side thereof;

wherein a frame is formed in said upper lay of said front cover by providing a display window in said upper layer of said front cover.

2. A scrapbook comprising:

a front cover having multi-layer structure forming a storage portion having an opening at a bound side thereof, between an upper layer and a lower layer of said multi-layer structure; and a bag-like display sheet, adapted to slide into said storage portion, wherein said display sheet is composed of a thin board and a transparent synthetic resin sheet which is laid on a surface of said thin board and forms a bag-like structure by adhering three sides thereof;

wherein a frame is formed in said upper lay of said front cover by providing a display window in said upper layer of said front cover.

3. A scrapbook comprising:

a spine adapted to bind a plurality of binder inserts:

a planar front cover coupled to said spine and having a front surface, said planar front cover including a co-planar storage area, a window in said front surface opening onto said co-planar storage area and an opening into said co-planar storage area wherein said opening is in a bound side edge of said front cover; and a planar display sheet having a substantially transparent front wall and a back wall, and adapted to receive contents for display between said front and back walls, and adapted to be inserted through said opening of said planar front cover and into said co-planar storage area of said front cover, whereby said contents for display may be seen through said window and said transparent front wall.

4. A scrapbook according to claim 3, wherein said planar display sheet is in the form of a bag.

5. A scrapbook according to claim 4, wherein said back wall of said planar display sheet is a relatively thin board.

6. A scrapbook according to claim 5, wherein:

the front wall of the planar display sheet is a substantially transparent synthetic resin;

the front and back walls of the planar display sheet are attached to each other along a majority of their respective peripheries, the un-attached peripheries providing an opening for said contents for display.

7. A scrapbook according to claim 6, wherein said front and back walls are substantailly rectangular, each having four edges, and are attached to each other along three of said four edges, providing an opening in said un-attached edge.

8. A scrapbook according to claim 4, wherein said front and back walls of said planar display sheet are substantially transparent synthetic resin and are are attached to each other along a majority of their respective peripheries, the un-attached peripheries providing an opening for said contents for display.

9. A scrapbook according to claim 8, wherein said front and back walls are substantailly rectangular, each having four edges, and are attached to each other along three of said four edges, providing an opening in said un-attached edge.

10. A scrapbook according to claim 3, wherein:

said front cover is a multi-layer construction having a top layer and a lower layer;

said storage area is provided between said top layer and said lower layer; and said top layer includes said window opening onto said storage area.

11. A scrapbook according to claim 10, wherein said front cover is substantially rectangular having four side edges.

12. A scrapbook according to claim 3, wherein said plurality of said binder sheets is variable.

13. A scrapbook comprising:

a spine adapted to bind a variable plurality of binder inserts;

a substantially rectangular and planar front cover coupled to said spine and having a front surface, said front cover including a co-planar storage area, a window in said front surface opening onto said co-planar storage area and an opening into said co-planar storage area wherein said opening is in a bound side edge of said front cover; and a substantially rectangular and planar, bag-like display sheet having a substantially transparent front wall and a back wall, and adapted to receive contents for display therein, and adapted to be inserted through said opening of said front cover and into said co-planar storage area of said front cover, whereby said contents for display may be seen through said window and said transparent front wall.

14. A scrapbook according to claim 13, wherein:

said back wall of said bag-like display sheet is a relatively thin board;

said front wall of the bag-like display sheet is a substantially transparent synthetic resin; and said front and back walls of said bag-like display sheet each have four edges, and are attached to each other along three of said four edges, providing an opening in said unattached edge.

15. A scrapbook according to claim 13, wherein:

said front and back walls of the bag-like display sheet are a substantially transparent synthetic resin; and said front and back walls of said bag-like display sheet each have four edges, and are attached to each other along three of said four edges, providing an opening in said unattached edge.

16. A scrapbook according to claim 13, wherein:

said front cover is a multi-layer construction having a top layer and a lower layer;

said storage area is provided between said top layer and said lower layer;

said top layer includes said window opening onto said storage area; and said front and back walls of the bag-like display sheet each have a top edge, a bottom edge and two side edges and are attached to each other along said bottom and side edges, providing an opening in said top edge.

17. A scrapbook according to claim 4, wherein said planar display sheet includes an opening at a top edge thereof.

* * * * *